United States Patent [19]

Burkhart et al.

[11] Patent Number: 4,479,591

[45] Date of Patent: Oct. 30, 1984

[54] APPARATUS AND METHOD FOR REMOVING FOREIGN MATERIALS FROM A CEMENT METERING WHEEL

[75] Inventors: George M. Burkhart, Strasburg; Joseph M. White, Millersville; Diane M. Witkonis, Lancaster, all of Pa.

[73] Assignee: Barber-Greene Company, Aurora, Ill.

[21] Appl. No.: 400,044

[22] Filed: Jul. 20, 1982

[51] Int. Cl.[3] ..... B01F 15/02

[52] U.S. Cl. ..... 222/317; 222/561; 366/193

[58] Field of Search ..... 222/148, 317, 609, 610, 222/368, 561, 279; 366/193

[56] References Cited

U.S. PATENT DOCUMENTS

| | | | |
|---|---|---|---|
| 737,953 | 9/1903 | McLaughlin | 222/368 X |
| 1,995,394 | 3/1935 | McCrery | 222/317 X |
| 2,851,200 | 9/1958 | DeFoa | 222/609 X |
| 3,209,601 | 8/1965 | Carson | 222/368 X |
| 3,310,293 | 3/1967 | Zimmerman | 366/6 |
| 3,655,104 | 4/1972 | Larson et al. | 222/317 |

*Primary Examiner*—Joseph J. Rolla
*Assistant Examiner*—Frederick R. Handren
*Attorney, Agent, or Firm*—Holman & Stern

[57] ABSTRACT

Access to a cement metering wheel for purposes of cleaning, without spilling cement from a storage tank disposed above the metering wheel, is provided by pivoting the wheel assembly downward and away from the bottom of the tank. A gate slot in the bottom of the tank is adapted to receive one or more blocking plates, prior to pivoting the wheel assembly, so as to block the gravity-feed outflow opening from the tank. Selectively removable slot covers are provided to prevent cement spillage from the open side of the slot during normal cement metering operation.

6 Claims, 8 Drawing Figures

APPARATUS AND METHOD FOR REMOVING FOREIGN MATERIALS FROM A CEMENT METERING WHEEL

TECHNICAL FIELD

The present invention relates to cement metering systems of the meter wheel type. More specifically, the present invention relates to cement feeding systems useful in mobile concrete mixers of the type described in U.S. Pat. No. 3,310,293 to Zimmerman, the disclosure of which is expressly incorporated herein by reference in its entirety, and of the type described in co-pending U.S. patent application Ser. No. 293,182, now abandoned, filed Aug. 17, 1981 by George M. Burkhart, Stanley M. Weatherholz and Martin F. Dohnalik and entitled "Meter Wheel and Scraper", the disclosure of which is also expressly incorporated herein by reference in its entirety.

BACKGROUND OF THE INVENTION

The invention described herein is particularly adapted for use in a system such as that disclosed in the aforementioned Zimmerman U.S. Pat. No. 3,310,293. The system disclosed in that patent permits separate storage of dry concrete constituents or ingredients in individual tanks or compartments. The ingredients are selectively fed in predetermined proportions to a mixing trough wherein they are mixed with water to form concrete of the desired characteristic. A metering system is disclosed for the stored cement wherein a drum or metering wheel, having a plurality of radially-extending vanes, is disposed at the bottom of the cement storage bin and rotates within a chamber to deliver metered amounts of cement to a conveyor belt passing below the metering wheel.

The aforementioned U.S. patent application Ser. No. 293,182 describes a method and apparatus for removing cement from the metering wheel periphery and vanes when such cement agglomerates thereon. However, there is another cleaning problem associated with cement metering wheels. Specifically, such metering wheels, by design, have a close tolerance in mating parts. It is not uncommon to find material in the cement powder, such foreign material taking the form of steel pieces, bolts, wood, etc. These objects will not pass through the metering wheel and will cause the shear pin on the wheel drive mechanism to shear. It is therefore necessary to have access to the interior of the wheel in order to remove foreign objects. However, any aperture large enough to permit removal of an object lodged in the cement wheel is also large enough for the cement to spill out during the feed from the gravity-feed storage tank. The spillage is both wasteful and messy. Of course, one can completely disassemble the metering wheel from the storage tank after the storage tank is empty; however, this is time consuming and inconvenient in that it requires emptying of the cement storage tank.

SUMMARY OF THE INVENTION

It is an object of the present invention to provide access to the interior of a cement metering wheel so that foreign objects can be quickly removed from the metering with minimal amounts of cement spillage.

It is another object of the present invention to adapt a mobile concrete mixer such that quick and simple access to the metering wheel is provided for clean-out with a minimum of cement spillage.

It is still another object of the present invention to provide a method and apparatus for providing access to a cement metering wheel disposed below a gravity-fed cement storage tank whereby spillage of the cement during normal operation and during the clean-out procedure is substantially eliminated.

In accordance with the present invention the cement metering wheel assembly is hinged on one side to the lower portion of the cement storage tank and retained from pivoting away from the storage tank bottom by means of a clamping arrangement. A slot is defined in a horizontal plane in the lower portion of the storage tank and, during normal cement feeding operation, permit cement to flow transversely therethrough. The single open side of the slot is covered by one or more cover plates having portions projecting partway into the slot so as not to block cement flow transversely through the slot. Upon removal of the cover plate, blocking plate members can be inserted into the slot to prevent cement from dropping through the slot and into the metering wheel chamber. The clamps can then be released so that the metering wheel assembly is pivoted away from the bottom of the storage tank and access is provided to the metering wheel for clean-out purposes.

BRIEF DESCRIPTION OF THE DRAWINGS

The present invention will be better understood and the objects other than those set forth above, will become more apparent, in view of the following detailed description of the invention. Such description refers to the annexed drawings which present a preferred embodiment of the present invention. In the drawings.

DESCRIPTION OF THE PREFERRED EMBODIMENTS

Figure 1:
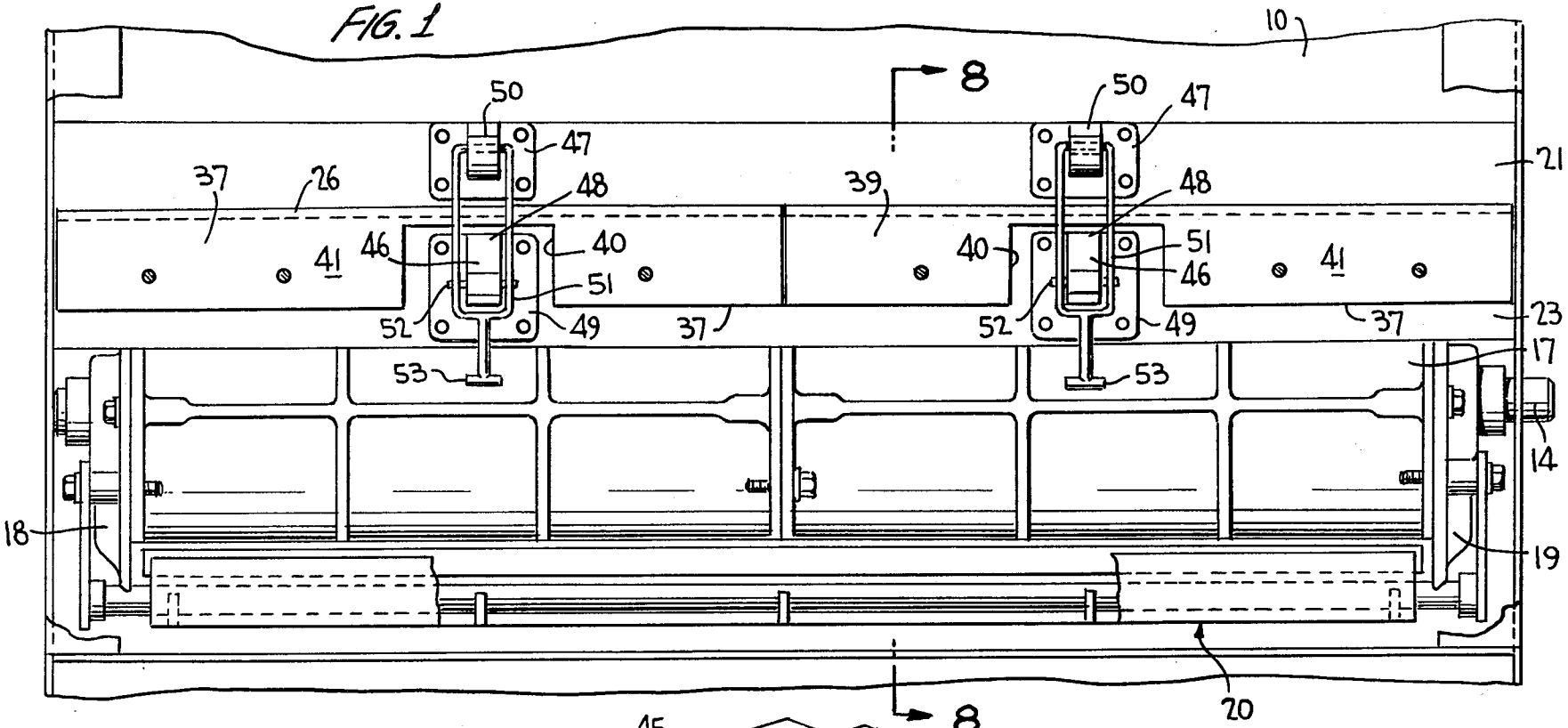
FIG. 1 is a front view in plan, partially broken, of the cement feeder and gating arrangement of the present invention.
Figure 4:
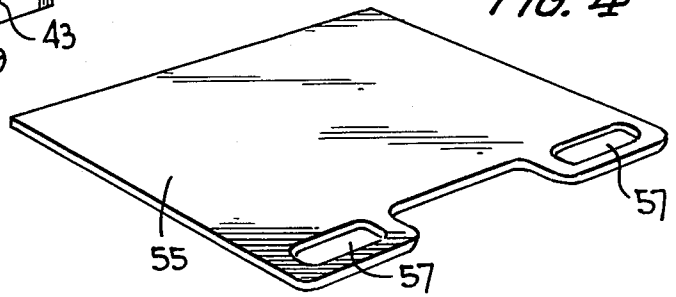
FIG. 4 is a view in perspective of a cement blocking plate employed to prevent flow of cement through the gating members during meter wheel clean-out.
Figure 3:
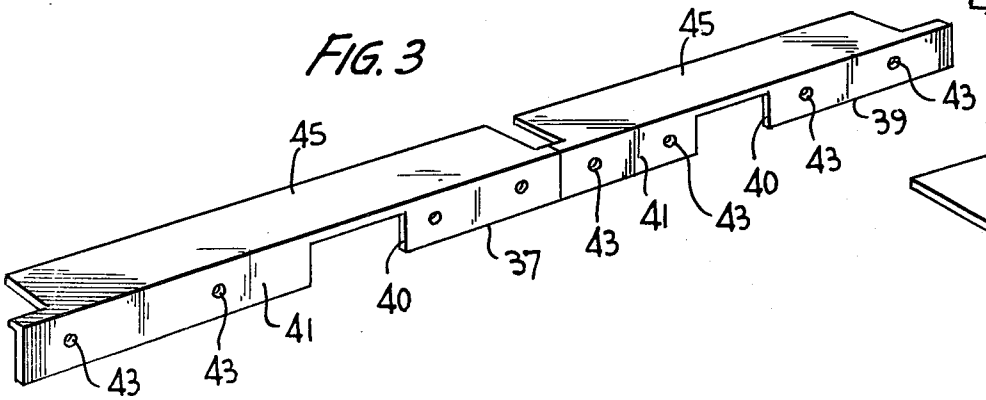
FIG. 3 is a view in perspective of two (2) slot cover members employed to prevent spillage of cement during normal operation of the cement feeder.
Figure 2:
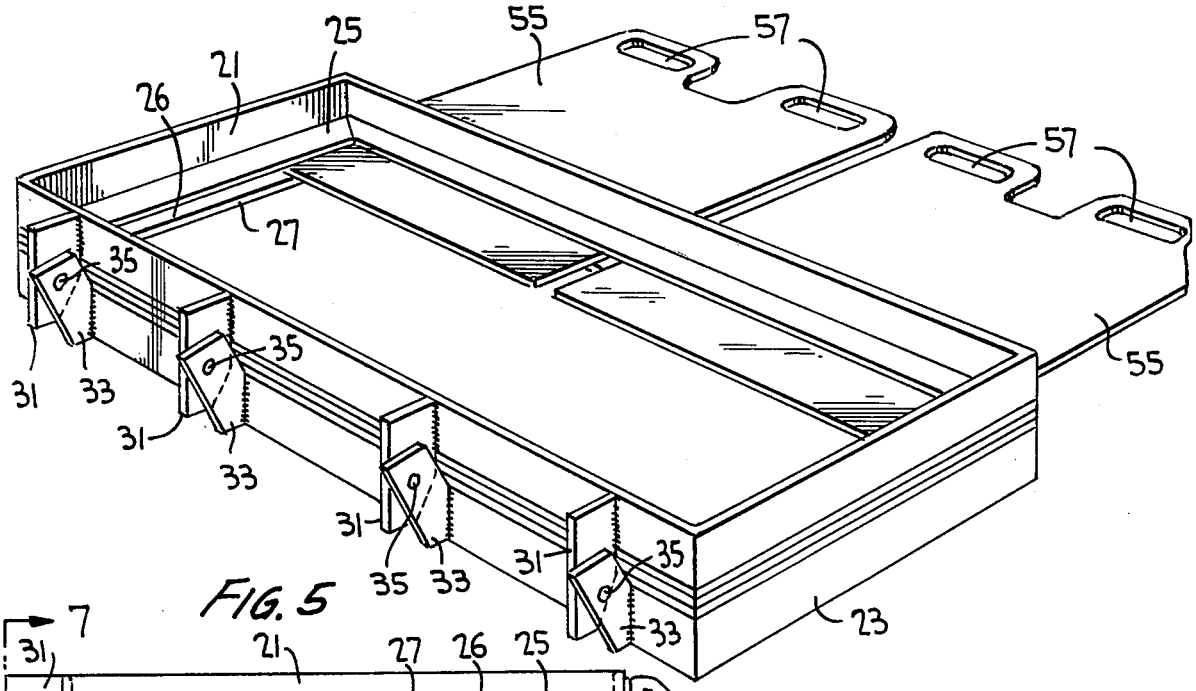
FIG. 2 is a view in perspective of the gating arrangement employed in the present invention.
Figure 5:
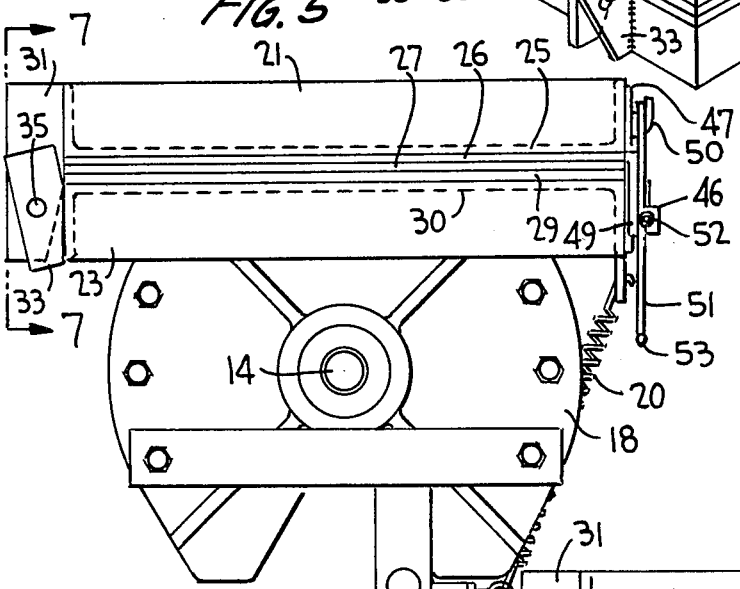
FIG. 5 is an end view of the cement feeder of FIG. 1 showing the gate in its closed position.

Referring to the drawings in greater detail, a portion of a mobile concrete mixing system of the type described in the aforementioned Zimmerman patent and the aforementioned U.S. patent application Ser. No. 293,182, includes a cement feeder disposed at the bottom of a cement storage bin or tank 10. The cement feeder receives, cement, by gravity feed, through an opening in the bottom of bin 10. The cement feeder includes a rotating drum or metering wheel 11 having radially projecting vanes 13. The metering wheel is driven for rotation about its longitudinal axis by a drive shaft 14 extending through the metering wheel chamber which is open at its top to receive the gravity-fed cement. The metering wheel chamber is also open at its bottom to permit discharge of the metered cement from the metering wheel chamber. The chamber includes front and rear walls 15, 17, respectively of generally arcuate configuration, which contacts the hips of vanes 13 as the metering wheel rotates in the chamber. The chamber is closed at its sides by side walls 18 and 19. A cement wheel scraper arrangement of the type described in the aforementioned U.S. patent application Ser. No. 293,182 is generally designated by the reference numeral 20 and serves to scrape the vanes so that agglomerated cement cannot accumulate thereon. An upper stationary gate member 21 is rigidly secured to the bottom of storage tank 10. A lower movable gate member 23 is rigidly secured to the top of the meter wheel chamber. The upper gate member 21 takes the form of a generally rectangular frame having a first generally rectangular lip 25 projecting inwardly of the frame. Lip 25 serves as the point of connection to the bottom of storage bin 10 and circumscribes an opening corresponding to the configuration of the opening at the bottom of the storage bin. A similar lip 27 also projects inwardly of frame 21 in spaced parallel relationship below lip 25. Lips 25 and 27 define a slot 26 therebetween which is open to the external environment only at the front of the feeder arrangement (which constitutes the rear of the mobile concrete mixer described in the aforementioned Zimmerman patent). The lower gate 23 has a rectangular frame-like configuration similar to gate member 21. An upper lip member 30 of gate member 23 is similar in configuration to lip member 27 and has a generally rectangular frame-like gasket disposed over its top surface. During normal cement feeding operation, the gasket 29 is disposed flush against the bottom surface of lip member 27 and the top surface of lip member 30. Under such circumstances, the cement can flow freely from the storage bin 10 through the lips 25, 27 and 30 to the metering wheel 11.

The entire metering wheel assembly is secured to the storage bin 10 by means of a pivotal engagement between gate members 21 and 23. Specifically, a plurality of flat pivot plates 31 are secured in horizontally spaced relation along a portion of one edge of each plate to the rear of upper gate member 21. Specifically, the plates 31 are disposed in vertical planes with the upper portions of their forward facing edges secured to the rear of upper gate member 21. The lower portions of these forward-facing edges of plates 31 are cut-away so as to diverge from the rear of gate 23 in a downward direction. A like plurality of flat hinge plates 33 are pivotally engaged with respective plates 31 by means of pivot connections 35. Flat hinges 33 are likewise disposed in vertical planes and have forward-facing edges wherein the bottom portion is cut-away and secured to the lower gate member 23. The upper portion of the forward facing edge of hinge members 33 thus diverge from the rear of upper gate member 21 in an upward direction. Each pair of pivot plate 31 and hinge 33 serves a pivot engagement along a common pivot axis extending horizontally and permits the forward end of gate 23 to be pivoted downward and away from the forward end of upper gate member 21. The cut-away lower portion of the forward-facing edge of each pivot plate 31 serves as a stop which contacts the rear of lower gate member 23 to limit the downward pivotal movement of that gate member.

The open forward end of slot 26 is covered during normal cement feeding operation by means of a pair of slot cover members 37. Each slot cover member is a horizontally-elongated member having a generally L-shaped cross-section defined by a vertical side 41 and a horizontal side 45. The vertical side 41 fits in an appropriately configured portion of the front wall of gate member 23 when the horizontal portion 45 extends partway into the slot 26 without blocking the flow path of cement through the lips 25, 27 and 30. The forward or vertical face of cover member 37 includes a plurality of through holes 43 through which screws may be inserted to secure these cover members to the gate member 23. The forward face 41 of each cover member is also provided with a cut-out portion 40 in the form of a three (3) sided channel which partially surrounds a respective clamp plate 49 secured to the front surface of gate member 23. A latch plate 47 is provided for each corresponding clamp plate 49 and is secured to the upper gate member 21 in vertical alignment with its corresponding clamp plate member 49. The latch plate 47 includes an upwardly projecting hook-like member 50 which is adapted to receive a generally rectangular clamp member 51 when the latch apparatus is engaged. A pivotal flap plate member 46 is pivotally engaged at 48 to the clamp plate 49 so as to be pivotable away from the clamp plate about a horizontal axis. The clamp member 51 is likewise pivotally engaged to the plate 46 so as to pivot about a horizontal axis 52 relative to that plate. A handle 53 permits selective release and engagement of the clamp member 51 to the hook 50. This latching apparatus, as described and illustrated, is conventional and permits the gate members 21 and 23 to be held in a closed abutting position when the clamp member 51 is engaged in hook 50. When the handle 53 is pulled forwardly, plate 46 pivots away from the clamp plate 49 and the clamp can be pivoted about its axis 52 until the clamp can be moved upwardly and free from the hook 50 so that the meter wheel assembly can pivot by means of its own weight downward and away from the upper gate member 21 and the storage bin 10.

In order to prevent spillage of the gravity-fed cement from the storage bin when the meter wheel assembly is pivoted away from the storage bin, a pair of blocking plates 55 are provided. These blocking plates are insertable into slot 26 after the cover members 37 are removed therefrom. In other words, each blocking plate 55 replaces a respective cover member and projects entirely across the front to back dimension of the slot so that both blocking plates together effectively block downward flow of cement from the storage bin 10. The cover members 37, on the other hand, serve to prevent spillage or leakage of the cement through the open forward side of slot 26 during normal cement feed operation.

Figure 6:
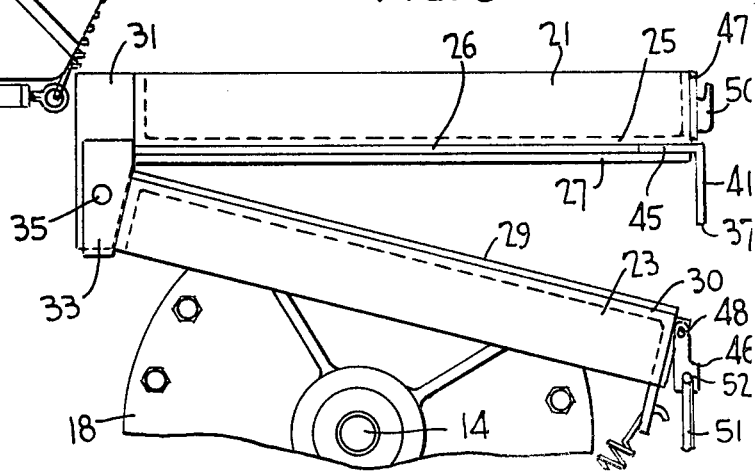
FIG. 6 is a partially broken end view similar to FIG. 5 but showing the gate in its open position.
Figure 7:
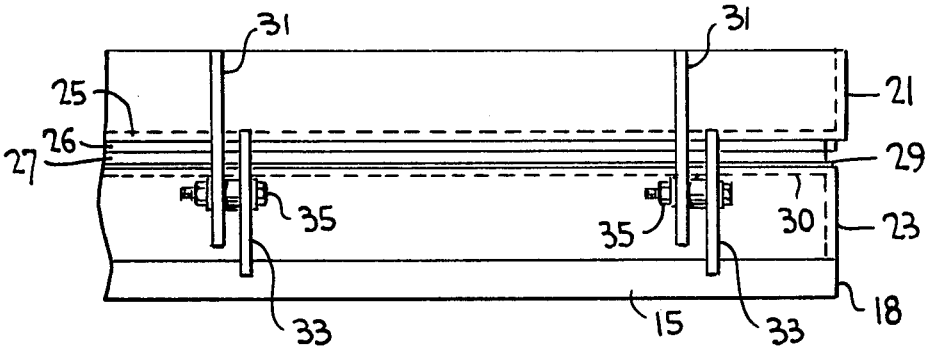
FIG. 7 is a partial rear view in plan of the cement feeder of FIG. 1 taken along lines 7—7 of FIG. 5.
Figure 8:
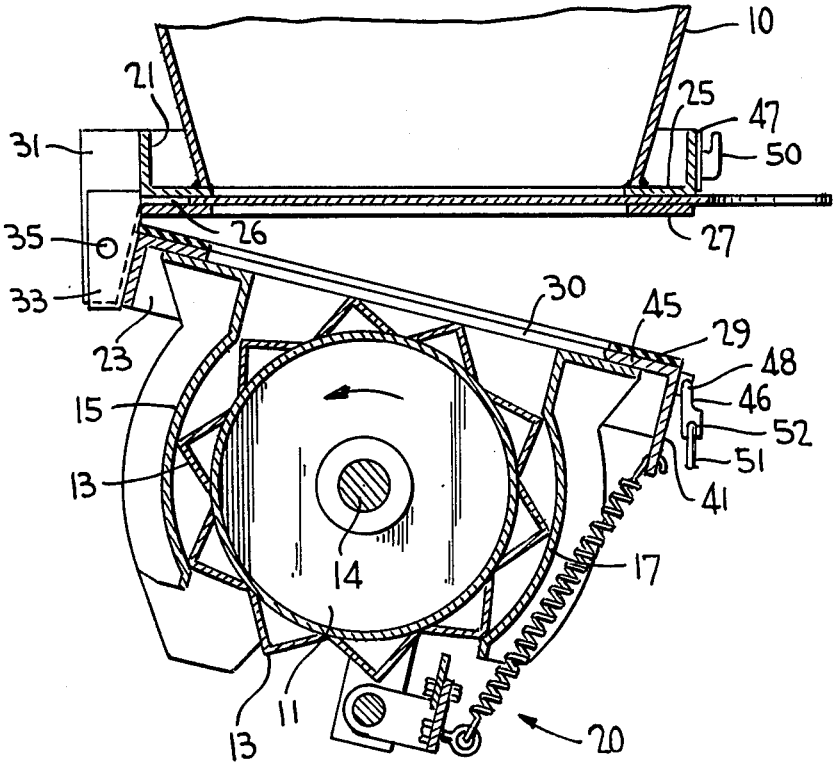
FIG. 8 is a view in section of the cement feeder arrangement of FIG. 1, the view being similar to that taken along lines 8—8 of FIG. 1 but wherein the gate member, rather than being closed as in FIG. 1, is open.

The procedure for effecting a clean-out of the metering wheel is as follows. Assuming a starting condition of normal cement feed wherein the latching arrangements are fully engaged, as illustrated in FIG. 1, the handles 53 of both latching arrangements are pulled slightly forwardly so as to remove the pivot plate 46 from its flush position against clamp plate 49 but not so far as to disengage clamps 51 from hook members 50. In this somewhat loosely held condition of the clamping arrangement, the screws holding cover members 37 to the lower gate member 23 are removed. With all of the screws removed, the cover members 37 are held loosely in place by the loosely engaged latches. One of the latches is then entirely opened by disengaging clamp 51 from its corresponding hook member 50. The corresponding cover member 37 is then entirely removed and replaced by a blocking plate 55 by grasping the handles 57 and inserting the opposite edge of the blocking plate into slot 26. The space between handles 57 permits the released latch to be loosely engaged once again in order to prevent the meter wheel assembly from dropping during removal of the other cover member and insertion of the other blocking plate. The other cover member 37 is removed in a similar manner and the other blocking plate 55 is inserted in a similar manner. With both blocking plates fully inserted into slot 26 so as to prevent downward flow of cement from the storage bin 10, both latches may be disengaged so that the meter wheel assembly can pivot to the open limit position illustrated in FIGS. 6 and 8. In this position access is provided to the metering wheel so that foreign objects and materials can be removed from the metering wheel.

After the metering wheel has been properly cleaned out, one of the clamps is partially engaged so that the other blocking plate 55 can be removed and replaced with a cover member 37. When the cover member is properly secured in place, its corresponding clamp is engaged and the other clamp is disengaged so that its blocking plate can be removed and the corresponding cover member secured in place. Both clamps are then fully engaged and the cement feed operation can proceed in normal fashion.

As noted above, the cover members 37 serve to prevent leakage of cement during normal feed operation. The blocking plates 55 prevent spillage of cement during clean-out. The cover members and blocking plates are therefore both required in order to prevent cement from leaking from the apparatus.

The particular configuration of the feed passage (i.e., rectangular) and other specific configurations described herein are by way of example only in order to describe a preferred embodiment of the present invention. It will be appreciated that other configurations may be employed and that the important aspect of the present invention is to permit pivoting of the meter wheel assembly away from the storage bin while protecting against spillage of the cement during both normal operation and during the clean-out procedure.

While this invention has been described in terms of a preferred embodiment, that is, an improved concrete handling system, it should be clearly understood that the invention is readily applicable to use wherein other semi-fluid materials are handled. Thus, it is clear that the objects set forth at the outset have been successfully achieved.

While we have described and illustrated a specific embodiment of our invention, it will be clear that variations of the details of construction which are specifically illustrated and described herein may be resorted to without departing from the true spirit and scope of the invention as defined in the appended claims.

What is claimed is:

1. A mobile concrete mixer having a body member with separate storage tanks for storing concrete ingredients, means for feeding said ingredients from each of said compartments at controlled rates to movable conveyor means for eventual mixing of the ingredients, wherein one of said tanks is a cement storage tank and said means for feeding ingredients includes a cement feeder disposed at the bottom of said cement storage tank, and including a generally cylindrical chamber having a horizontally-disposed longitudinal axis and longitudinally-extending horizontal top and bottom openings to receive and discharge cement, respectively, from the cement storage bin, a rotatable drum disposed in said chamber, a plurality of angularly spaced vanes secured to the periphery of said drum and arranged to define rotatable compartments for cement between the vanes and the walls of said chamber, said cement feeder including clean-out means for providing access to said drum while preventing cement from spilling out of said storage tank, said clean-out means comprising:

gating means comprising a first gate member disposed at the bottom of said storage tank and a second gate member disposed at the top of said chamber, said gate members having frame-like configurations to permit free passage of cement from said storage tank through said gate members to said chamber;

pivotal engagement means securing said gate members to one another for pivotal motion about a generally horizontal axis between parallel abutting and angularly spaced limit positions and such that the weight of said chamber normally biases said second gate member downward and away from said first gate member to said angularly spaced position;

latching means for selectively engaging said first and second gate members together in said parallel abutting position;

wherein said first gate member has a generally horizontally disposed slot defined therein;

selectively removable slot cover means for covering said slot from the external environment to prevent spillage of cement which falls from the storage tank to said chamber during normal cement metering operation;

cement blocking means adapted to be inserted into said slot when said slot cover means is removed in order to prevent passage of cement from said storage tank through said first gate member, said first gate member being a generally rectangular frame, wherein said slot is defined between two generally rectangular spaced lips which project inwardly from said rectangular frame in parallel relation, said slots being open to the environment external to said concrete mixer on only one side, and said latching means comprising first and second latch and hook devices disposed in horizontally spaced locations along said one side of said slot on said first and second gate members; respectively, wherein said slot cover means includes first and second elongated cover members having L-shaped cross-sections in which one leg is adapted to fit partially into said slot from said open side, said cover members being arranged to fit side by side in said slot to cover said open side of said slot while permitting flow of cement through said first gate member, and wherein the other leg of each of said cover members includes a cut-out portion which partially surrounds a latch mechanism of a respective latching means when the cover members are positioned in said slot.

2. The concrete mixer according to claim 1, wherein said slot cover means includes at least one member having a generally L-shaped cross-section, wherein one leg of said L-shaped cross-section is adapted to fit only partially into said slot to cover said opening of said slot while permitting free flow of cement through said first gate member.

3. The concrete mixer according to claim 2, wherein said cement blocking means comprises at least one plate member adapted to fit into said slot through said open side to completely block transverse cement flow through said first gate member.

4. The concrete mixer according to claim 1, wherein said cement blocking means comprises first and second plate members adapted to fit into said slot through said open end when respective cover members are removed, said plate members having a total area which is sufficient to block transverse flow of cement through said first gate member.

5. Apparatus for providing access to a cement metering wheel for cleaning the wheel without spilling cement delivered by gravity-feed from a storage tank disposed above the metering wheel, said apparatus comprising:

first and second frame-like gate members disposed one above the other between said storage tank and said metering wheel;

pivotal engagement means securing said first and second gate members to one another along one side thereof to permit mutual pivotal movement between open and closed positions, said gate members being disposed in parallel abutting relation in said closed position and being angularly spaced in said open position, said second gate member being biased by its weight toward said second position;

latching means for selectively engaging said first and second gate members in said closed position;

wherein said first gate member has a generally horizontally disposed slot defined therein;

selectively removable slot cover means for covering said slot from the external environment to prevent spillage of cement which falls from said storage tank to said metering wheel during normal cement metering operation;

cement blocking means adapted to be inserted into said slot when said slot cover means is removed to prevent passage of cement from said storage tank through said first gate member, said first gate member being a generally rectangular frame, wherein said slot is defined between two generally rectangular spaced lips which project inwardly from said rectangular frame in parallel relation, said slots being open to the environment external to said concrete mixer on only one side, and said latching means comprises first and second latch and hook devices disposed in horizontally spaced locations along said one side of said slot on said first and second gate members, respectively, wherein said slot cover means includes first and second elongated cover members having L-shaped cross-sections in which one leg is adapted to fit partially into said slot from said open side, said cover members being arranged to fit side by side in said slot to cover said open side of said slot while permitting flow of cement through said first gate member, and wherein the other leg of each of said cover members includes a cut-out portion which partially surrounds a latch mechanism of a respective latching means when the cover members are positioned in said slot.

6. The concrete mixer according to claim 5, wherein said cement blocking means comprises first and second plate members adapted to fit into said slot through said open side when respective cover members are removed, said plate members having a total area which is sufficient to block flow of cement through said first gate member.

* * * * *